United States Patent [19]

Rubio

[11] 4,326,455

[45] Apr. 27, 1982

[54] CONTINUOUS PRODUCTION OF GRAIN PRODUCTS

[76] Inventor: Manuel J. Rubio, 192 Benham Ave., Bridgeport, Conn. 06605

[21] Appl. No.: 22,788

[22] Filed: Mar. 22, 1979

[51] Int. Cl.[3] ..... B02B 1/04; B02B 7/02

[52] U.S. Cl. ..... 99/483; 99/516; 241/186 R; 241/189 R

[58] Field of Search ..... 99/483, 516, 534, 536; 426/622, 626; 241/186 R, 189, 194, 187

[56] References Cited

U.S. PATENT DOCUMENTS

| | | | |
|---|---|---|---|
| 1,759,905 | 5/1930 | Keith | 241/186 |
| 2,704,257 | 3/1955 | Sollano et al. | 426/622 |
| 3,117,868 | 1/1964 | Madrazo et al. | 426/622 |
| 3,194,664 | 7/1965 | Eytinge | 99/534 |
| 3,369,908 | 2/1968 | Gonzalez et al. | 426/622 |
| 3,857,519 | 12/1974 | Schafer et al. | 241/189 R |

FOREIGN PATENT DOCUMENTS

| | | | |
|---|---|---|---|
| 727212 | 3/1955 | United Kingdom | 241/187 |
| 495085 | 4/1976 | U.S.S.R. | 241/186 R |

*Primary Examiner*—Philip R. Coe
*Assistant Examiner*—Timothy F. Simone
*Attorney, Agent, or Firm*—William G. Rhines

[57] ABSTRACT

Embodiments of this invention include methods and apparatus for the production of flour from which products such as corn tortillas, tortilla chips, "taco shells", and the like, may be produced, in a continuous process, by pre-cooking the grain, stabilizing its moisture content, milling it to particulate form for suspension in a super-heated stream of air, replacing the ambient air with air which has lower moisture content and is cooler, and segregating out the flour-size particles from larger particles which are further processed into flour.

5 Claims, 2 Drawing Figures

CONTINUOUS PRODUCTION OF GRAIN PRODUCTS

BACKGROUND OF INVENTION

In the production of certain products, such as tortillas, tortilla chips, "tacos" shells, and the like, from grains such as corn, it is known that the basic grain material must be partially cooked before it is formed into the end product, so as to cause it to be partially gelatinized, reduced in particle size, and sufficiently nixtamalized. By "nixtamalized" is meant breaking the corn grain hull down toward a gelatinized state by cooking in lime-water. In the past, this has been done by processes where the grain is cooked in a lime-water solution, in a batch process such as that disclosed in U.S. Pat. No. 2,584,893, or in a continuous process such as that disclosed in U.S. Pat. No. 3,194,664, or in a semi-continuous process such as that disclosed in U.S. Pat. No. 2,704,557, and subsequently ground and dried to produce flour from which such corn products may be made.

It is desired to produce such flour-like material so that the home owner, small merchant, or other user may make up relatively smaller quantities of desired end products. Further, it is desired to produce such flour-like material by a continuous, rather than a batch process, in the interests of realizing production efficiencies and cost savings, as well as economies of space. In addition, it is desired to produce a higher quality product than has been possible in the past.

Accordingly, an object of this invention is to produce material for the production of end products from grains such as corn.

Another object is to achieve this objective in the form of a flour-like material.

Yet another objective is to achieve these objectives utilizing a continuous process.

Still another objective is to attain these objectives in a way which is efficient and comparatively less expensive.

Another objective is to achieve these objectives and to produce flour-like products which are relatively uniform and homogeneous in their physical properties.

SUMMARY OF INVENTION

Desired objectives may be achieved through practice of the present invention, embodiments of which comprise continuous process methods and apparatus for pre-cooking corn, stabilizing its moisture content, milling it to an air-suspendable condition, entraining it in a stream of super-heated air, and separating and recovering the fine particles so produced from the coarse particles while the latter are further processed to render from them additional fine-particle material, including novel milling apparatus by means of which, milled particles may be introduced directly into the center of the super-heated air stream in a less pre-cooked condition for rapid and uniform cooking without significant sticking or burning.

DESCRIPTION OF DRAWINGS

This invention may be understood from the description which follows and from the appended drawings in which.

DESCRIPTION OF PREFERRED EMBODIMENTS

Figure 1:
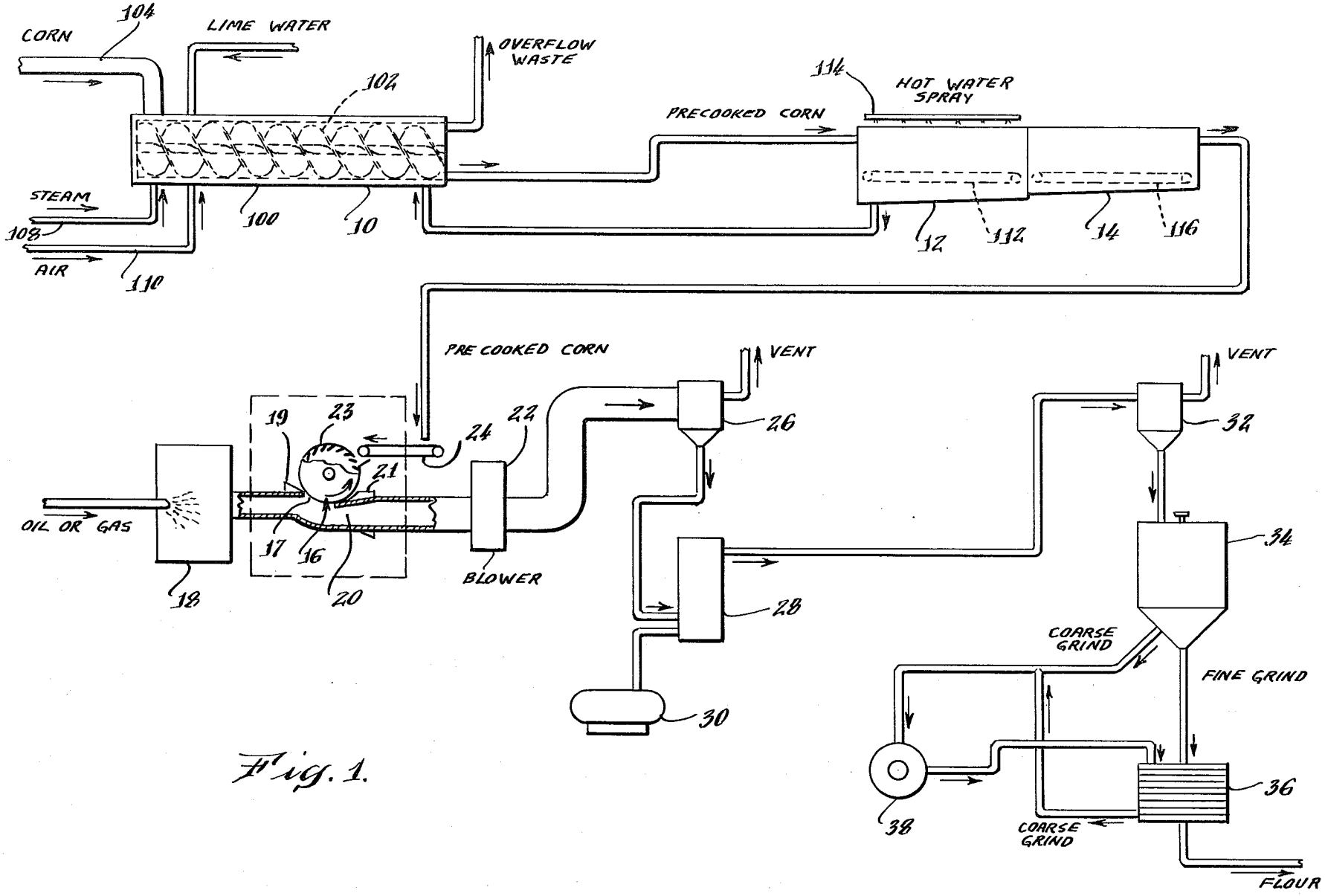
FIG. 1 depicts an embodiment of this invention.

Referring first to FIG. 1, there is depicted, in flow diagram form, an embodiment of the present invention. It includes a pre-cooker 10; a washer 12; a pre-conditioner 14; a primary mill 16 with an associated furnace 18, venturi 20, blower 22, and feeder belt 24; a first cyclone separator 26; a cooler 28 with an associated blower 30; a second cyclone separator 32; an air-classifier 34; a segregator 36; and a secondary mill 38.

The pre-cooker 10 is a steam heated, cylindrical chamber 100 in which is positioned a screw conveyor 102, typically having four "flutes" or helices per revolution with a diameter ratio of 4 to 1 and a volumetric efficiency of about 55%. Into the pre-cooker, corn and lime water are fed through pipes 104, 106, to form an acqueous suspension which may be heated by steam and aerated through other pipes 108, 110 respectively. By regulating the amount of heat introduced via the steam, in coordination with the screw speed, it is possible to achieve the desired cooking cycle of 94° to 86° C. for 20–30 minutes. This permits nixtamal to be produced at moisture contents of between 35 and 37%, compared to the 46 to 51% previously used in the industry, while the pH is raised to about 11.5 with the addition of calcium hydroxide. Water loss in the process is replaced with wash water from the washer 12, which is regulated to keep the solid content of the cooker solution at about 3%. By use of this pre-cooker, a very uniform and constant set of conditions may be maintained, at relatively low moisture content, permitting the production of more homogeneous products while realizing economies of as much as 50–75% in water saving (with correspondingly reduced adverse environmental effects), 50% in heat, and 65% in lime; compared to the previously used batch processes. There are also realized better quality control of the product and space and labor efficiencies.

The now partially cooked corn is then passed to a washer where, while ample drainage is provided, for example by an endless mesh belt 112, the corn is subjected to water at a temperature of about 90° C. through nozzles 114, to wash off excess lime-water and to impart heat to the corn for subsequent further processing.

The corn is then passed to the pre-conditioner 14 where a layer of corn, typically 35–50 cm. thick, is deposited on an endless belt 116 by which the corn may be subjected to a transit time through the unit of 35–60 minutes, to cause the residual moisture content of between 2 and 3% from between the corn kernels to be re-absorbed by the corn. Unlike the prior art processes, this enhances the mechanical grinding processes which are to follow, and further aids in making the end product more uniform, because there is no soft outer surface of the kernels to foul the milling surfaces and the moisture content of the kernels cross-sectionally is more nearly uniform. It occurs because, instead of centrifuging off the intersticial water as in the past, the heat imparted to the grain by the hot water sprayed through the nozzles 114 makes it possible for the grain to re-absorb the intersticial water. The corn so treated may then be passed to a primary mill 16 by means of a belt feed 24.

Figure 2:
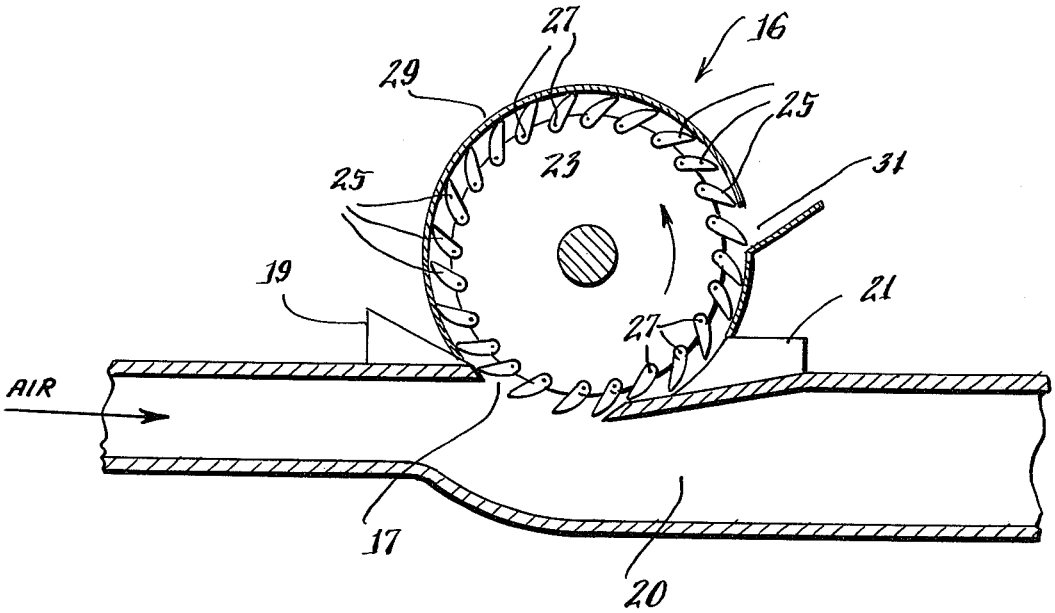
FIG. 2 illustrates a hammer mill useful in carrying out the present invention.

The mill 16, as illustrated with greater particularity in FIG. 2 than is shown in FIG. 1, is of different design than that of the usual grain hammer-mill. Like other such hammer-mills, it has a central, drum-like wheel 23 to the cylindrical outer face of which "hammers" 25, in the form of strips of metal, are pivotally affixed by means of pintles 27. The mill has an associated outer shroud 29, with a feed aperture 31 through which grain may be fed into the mill. In operation, the wheel 23 turns at a relatively high speed, causing the hammers 25 to be swung outward by centrifugal force, so that the outer ends of the hammers 25 impinge against the inside of the shroud 29, thereby performing a milling operation on the grain which has been introduced into the mill through the aperture 31. This mill, however, is different from prior art mills as follows.

The mill 16 is without the grid or plate that is usually positioned at the opening 17 between the lip flanges 19, 21, and the milling wheel 23 is made to turn in the direction of the arrow shown on FIGS. 1 and 2; which is opposite the direction in which the milling roll in such machines usually turns, so that in this mill, the particles are injected in the same direction as the air stream is moving rather than against it.

The hammer mill 16 has an associated specially designed venturi 20 into which the milled corn and hot air coming from a furnace 18 are introduced and impelled by means of a blower 22. Thus, the mill 16 is made so that the milled corn is discharged directly into the throat of the venturi, as a suspension of fine particles in air at a temperature of 550°–650° C., which is traveling at at least 30 meters per minute. By this means, the corn is reduced to a moisture content of 16–18%, and is partially gelatinized or cooked in a few seconds to an extent that would require as much as 2 hours in the cooking processes previously used, and utilizing considerably less space. In addition, since the milled corn is introduced as fine particles into the center of the air stream, it is cooked rapidly and uniformly, and without significant contact with the wall of the venturi due to the presence of the intervening layer of air, with consequent reduction in burning of the corn and sticking to the walls of the venturi because of contact with the hot metal walls. By virtue of this apparatus and method, it is possible to achieve economies in heat utilization, faster and better cooking, better control of particles, and savings in space for the drying operations.

Moisture laden air is extracted at the first cyclone separator 26 so that further moisture extraction may take place by impelling the corn through a cooler 28 with air introduced by the blower 30, thus further reducing the moisture content from 16–18% to 9–12%; the final desired humidity within this range being dependent upon the desired shelf-life of the end product. After further removal of moisture-laden air in the second cyclone separator 32, the further cooked product is admitted into an air-classifier of known per-se design, where coarser particles are separated from fine particles; the latter being directed to the segregator 36 where, for example using vibrating sieve screens of 35–60 mesh, the finest material is permitted to be discharged as flour. The coarse particles from this air-classifier 34 and those from the segregator 36 may be further milled in secondary mill 38, the product of which is again introduced into the segregator 36, all as shown in FIG. 1.

From the foregoing, it will be apparent that it is possible to produce flour-like material, made from grain such as corn, by a continuous process which utilizes relatively small space and is highly efficient in its utilization of energy and ancillary products; the end products being remarkably uniform in quality and having desirable handling and shelf-life characteristics. In addition, the flour produced is more hygroscopic, making it more susceptible to being rendered into dough.

It is to be understood that the embodiments herein described and shown, are by way of illustration and not limitation, and that other embodiments may be made without departing from the spirit of scope of this invention.

I claim:

1. Apparatus for making flour from grain, comprising a pre-cooker for continuously partially cooking grain in water under controlled conditions of heat, time and pH, a washer for washing the grain which has been cooked in said pre-cooker, a pre-conditioner to stabilize the moisture content of grain, which has been washed in said washer, means for producing a super-heated stream of air and causing said stream of air to pass through a conduit, a mill for reducing said grain which has been processed in said preconditioner to particles and for introducing said particles into the central region of said stream of super-heated air as it travels through a conduit of desired configuration, wherein said mill comprises a roll, an unobstructed portion of the face of which is so positioned as to be impinged-upon by said stream of air and normally turns so that said portion of said face of said roll moves in the direction of travel of said stream of air, said conduit being adjacent said mill, and means for discriminating particles larger in size than a predetermined dimension from those which are smaller and for accumulating said smaller particles.

2. The apparatus described in claim 1 wherein a portion of said conduit is configured as a venturi, with said particles being introduced into said conduit in the flow path of said stream of air prior to said stream of air passing through said portion of said conduit.

3. For use in apparatus for making flour from grain a mill for reducing said grain to particles and for introducing said particles into a stream of super-heated air passing through an associated duct, said mill including a roll, and a roll housing having a discharge aperture which is unobstructed, which roll normally turns so that the portion of the face thereof adjacent said aperture moves in the direction of travel of said stream of air, said mill being structurally adapted for interconnection to said duct with said duct oriented substantially tangential to said roll and with said aperture opening into said duct and so positioned as to be impinged upon by said stream of air.

4. The mill described in claim 3 including a duct surrounding said aperture, which duct is configured as a venturi, the throat of which is downstream of said aperture relative to the path of travel of said stream of air.

5. The mill described in claims 3 or 4 in the form of a hammer mill having centrifugal force actuated hammers pivotally affixed to the cylindrical surface of said roll for impingement against the inner surface of surrounding shroud assicated therewith to mill grain located between said hammers and said inner surface.

* * * * *